US005582267A

United States Patent [19]

Bockoven et al.

[11] Patent Number: 5,582,267

[45] Date of Patent: Dec. 10, 1996

[54] COLLAPSIBLE WORK SUPPORT DEVICE

[76] Inventors: Robert E. Bockoven, 4140 N. Glen, Kingman, Ariz. 86401; Brian D. Bockoven, 1654 Tremont Cir., Kettering, Ohio 45429; David J. Bockoven, 2702 Shafor Blvd., Oakwood, Ohio 43419

[21] Appl. No.: 317,020

[22] Filed: Oct. 3, 1994

[51] Int. Cl.[6] ..... B27B 21/00

[52] U.S. Cl. ..... 182/153; 182/224; 182/181

[58] Field of Search ..... 182/153, 151, 182/155, 181–186, 224–226; 248/167; 108/124, 121, 128, 127, 134, 135

[56] References Cited

U.S. PATENT DOCUMENTS

| | | | |
|---|---|---|---|
| 1,222,893 | 5/1917 | Beckwith . | |
| 1,238,142 | 8/1917 | Hitchcock | 248/167 X |
| 1,935,896 | 11/1933 | Wertz | 304/7 |
| 2,326,565 | 8/1943 | Ripley | 248/436 |
| 2,829,927 | 5/1958 | Sword | 304/5 |
| 2,874,004 | 2/1959 | Tucker | 304/5 |
| 2,925,140 | 2/1960 | Thielepape | 182/155 |
| 3,217,673 | 11/1965 | Knoblock | 248/167 X |
| 3,313,249 | 4/1967 | Marcy | 108/124 |
| 3,502,174 | 3/1970 | Cannon | 182/155 |
| 3,805,710 | 4/1974 | Leshem | 108/124 X |
| 4,286,831 | 9/1981 | Beers | 108/124 X |
| 4,620,613 | 11/1986 | Albertson | 182/153 |
| 4,763,757 | 8/1988 | Cheney | 182/153 X |
| 5,184,697 | 2/1993 | Crewe et al. | 182/225 X |
| 5,215,162 | 6/1993 | Parks et al. | 182/153 |

FOREIGN PATENT DOCUMENTS

| | | | |
|---|---|---|---|
| 668398 | 11/1938 | Germany | 108/124 |

*Primary Examiner*—Karen J. Chotkowski
*Attorney, Agent, or Firm*—Reuben Wolk

[57] ABSTRACT

A collapsible work support device for use either as a work bench, or as a saw horse when used in conjunction with another such device. The device has an elongated beam used as the principal working member, which is placed on a separate support assembly consisting of a main support and two side supports hingedly attached thereto. The side supports are placed in an open position to cooperate with the main support to form a three-sided member for supporting the beam when in position for use. When the device is to be collapsed for storage, the top beam is removed, the side supports are folded into a closed position flat against the main supports, and the top beam is turned sideways and secured to the support assembly into the collapsed position. The device then becomes a compact unit that may be easily transported or stored.

19 Claims, 2 Drawing Sheets

COLLAPSIBLE WORK SUPPORT DEVICE

BACKGROUND OF THE INVENTION

The present invention relates to a work support device which may be used by itself as a work bench, or in pairs to be used as a sawhorse. The device is collapsible so that it may be readily transported and stored as a unit, but easily opened for use.

PRIOR ART STATEMENT

Collapsible work devices previously known are complex and cumbersome. Typical of such devices, usually referred to as trestles or sawhorses which are known to us, are shown in U.S. Pat. Nos. 224,893; 1,935,896; 1,829,927; 2,874,004; 2,925,140; 3,502,174; 4,620,613; and 5,215,162. These devices primarily contemplate the use of conventional vertical support legs which are hinged to fold flat to enhance portability or storage.

SUMMARY OF THE INVENTION

The present invention represents an entirely different approach to the problem of portability and storage of a work support device. The principal working beam is an elongated member, supported by a separate support assembly. This assembly consists of a principal support and two side supports which are hingedly attached to the principal support and placed in an open position so that they are at approximately at right angles to the back member. The top surfaces of the side supports have slots so that the working beam assembly engages the slots to lock the entire device together when in position for use. When it is desired to collapse the device for portability or storage, the working beam assembly is removed from the slots and the side supports are folded flat against the back support. The device is then locked together by turning the beam assembly sideways; locking lugs secured to the bottom of the beam assembly having matching cross-sections with the slots, are placed into the slots. These lugs have integral rotatable members which are operable in order to lock the beam assembly into these slots. The result is a compactly folded assembled device.

It is therefore a principal object of the invention to provide a novel collapsible work support device having a working member in the form of a beam.

It is a further object to provide a support assembly which is separate from the working beam.

It is another object to provide means for placing the working beam into the support assembly to interlock the beam with the support assembly.

It is still another object to provide means for collapsing said support assembly and interlocking it with the working beam for improved portability and storage.

It is an additional object to provide a simple method of interlocking the working beam and support assembly.

These and other objects of the invention, and the details thereof, are shown and described in relation to the preferred embodiment in the following specification and drawings.

DESCRIPTION OF THE PREFERRED EMBODIMENT

Figure 1:
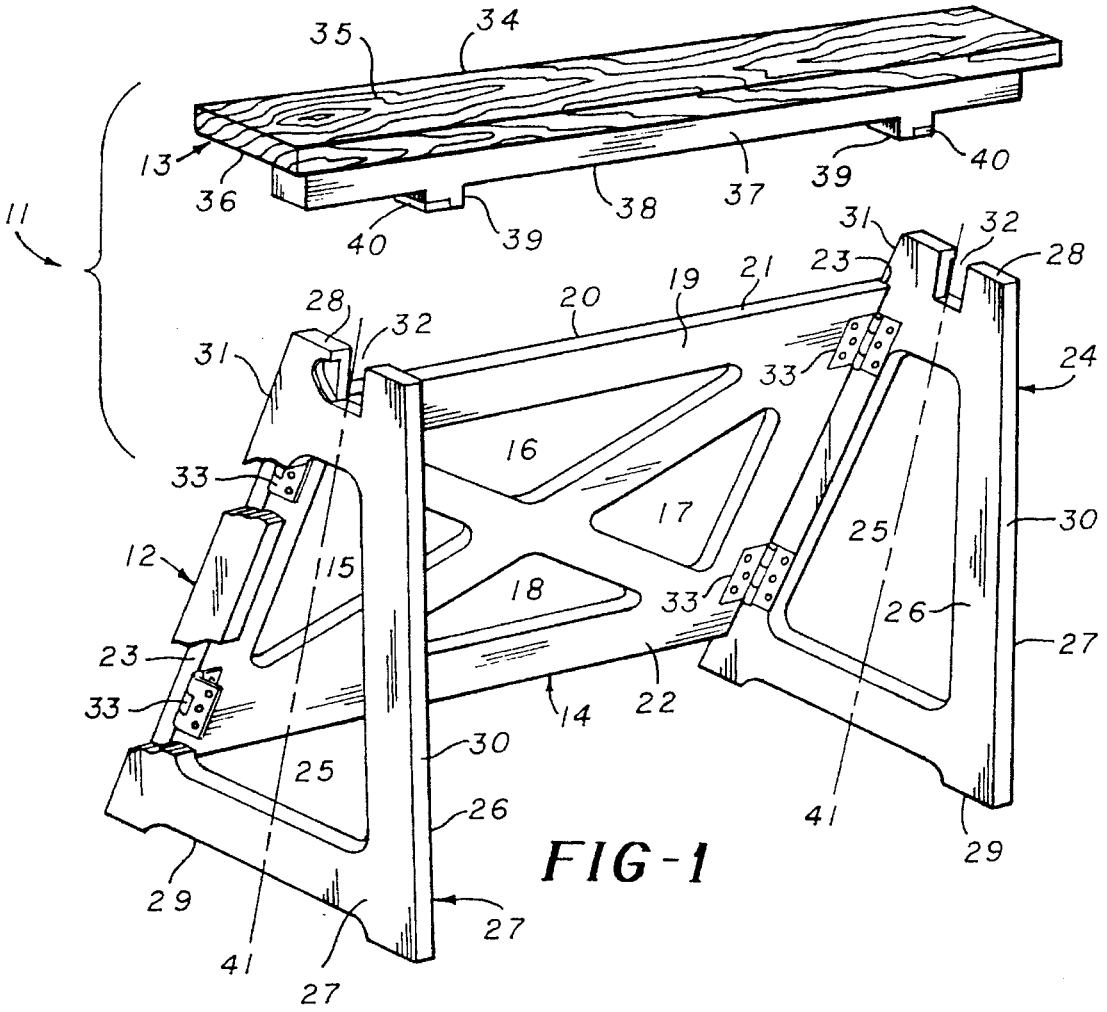
FIG. 1 is an exploded perspective view of the novel work support device, prior to assembly.

Referring now to FIG. 1, The novel work support device is designated by reference numeral 11, and consists of a support assembly 12 and a separate working member in the form of beam assembly 13. The support assembly consists of a planar main support 14 and two identical planar sides 24 which are attached to the support 14 by means of hinges 33 secured to the inner faces 26 of the side supports and to the inner face 19 of the main support. The supports 14 and 24 are preferably made of a high strength plastic material, such as ABS or polycarbonate, formed by well-known processes as injection molding. This material also be a high strength structural foam plastic, such as polypropylene, polyester, or the like. The supports may also be made of wood or metal, such as aluminum. The members are preferably approximately one half to one inch thick. The main support 14 is rectangular in shape, and has openings 15, 16, 17 and 18 to reduce the weight of the support without loss of strength. Obviously this pattern of openings can be varied as desired. The support has an inner face 19 facing the side supports, an outer face 20 which is away from the side supports, top edge 21, bottom edge 22, and side edges 23. The side supports 24 are also preferably formed with openings 25 for weight conservation, these supports being tapered from a wide bottom edge 29 to a narrower upper edge 28, generally forming a trapezoid. The inner faces 26 of these supports abut the side edges 23 of, and are approximately at right angles to, the main support, and the outer faces 27 are away from the opening formed by the main and side supports. The supports 24 also have side edges 30 and rear edges 31. Rectangular slots 32 are formed in the top edges 28, with their sides parallel to the longitudinal axis 41 of the side supports. The slots are in alignment with each other when the supports are in the open position shown. In this position the main and side supports form an open box-like arrangement, configured as a three-sided member defining an open space.

Figure 2:
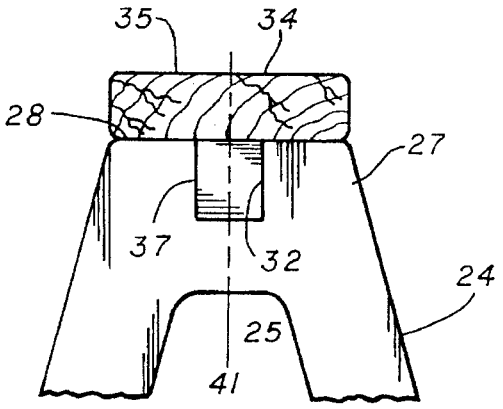
FIG. 2 is a partial end elevational view illustrating the assembled device.

The working member or beam assembly 13 consists of a principal beam 34, such as a wooden 2×6 or 2×8 member, having an upper or outer surface 35 and a lower or inner surface 36. A narrower and shorter beam support 37 is secured to the surface 36 and extends along the longitudinal extent of the beam. The beam and the beam support are preferably made of wood, but may be a high strength plastic or structual foam plastic similar to the material used to make the supports, or plastic. The beam support has a rectangular cross-section of about one and one-half by two inches. However, it is contemplated that instead of a continuous beam support, the same purpose may be accomplished by utilizing short members located in juxtaposition to the slots. A pair of lugs 39, having lug locks 40 attached thereto, is secured to the inner surface 38 of the beam support, or may be integrally molded thereto. To place the device in position for use, the beam assembly is locked in place with the support assembly by dropping the beam support into the slots 32 as shown in FIG. 2, the support having a cross-section matching that of the slots. The slots are rectangular in cross-section and have vertical sides parallel to the vertical axes of the supports. The slots are in alignment on an axis parallel to the elongated extent of the working member. The lugs are spaced inwardly of the slots, and are primarily for locking purposes as will be described later, but also serve to limit longitudinal movement of the beam assembly in the slots. Also, other members, such as pins, may be mounted on the inner surface of the working member to limit movement. As an alternative to separate principal beam and support beam members, these may be made of a one-piece extruded plastic member, made of material similar to that of the support members. When the device is used as a work bench, the complete assembly now provides a sturdy device in which the open box-like support assembly allows the user a place for his legs if he is standing, or for placement of a work stool if he is sitting; yet places him in close proximity to the working beam upon which he is doing his work. In the position shown, the side supports are in planes parallel to each other and at right angles to the horizontal plane of the working member, whereas the main support is in a plane at an angle with the planes of the side supports and the working member.

Figure 3:
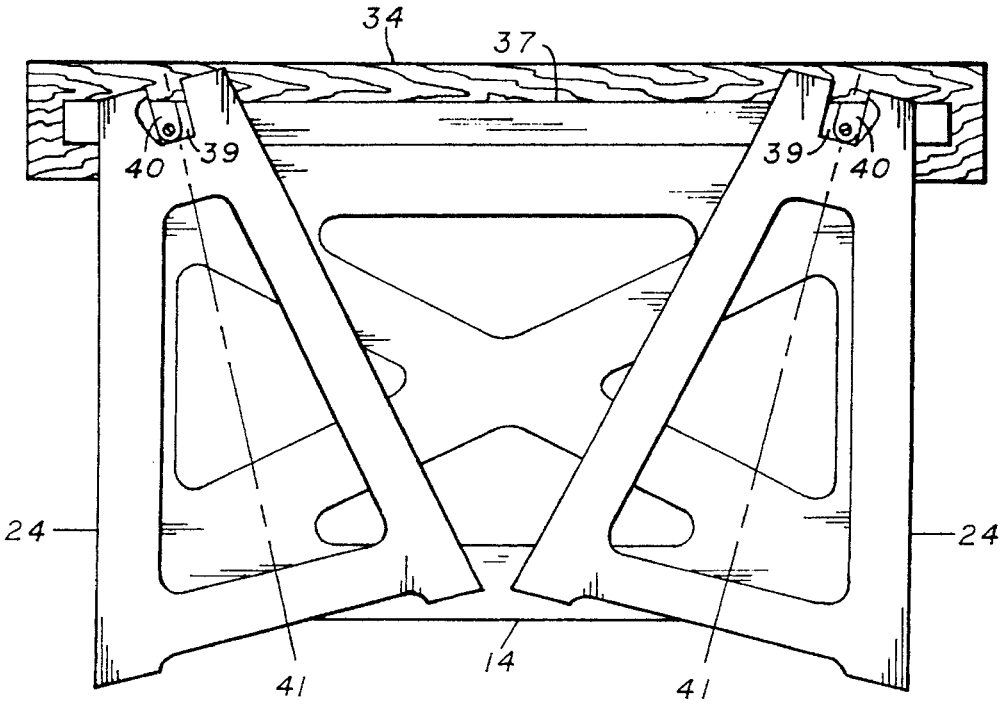
FIG. 3 is a front elevational view of the collapsed support assembly, with the working beam turned into position for assembly and storage.
Figure 4:
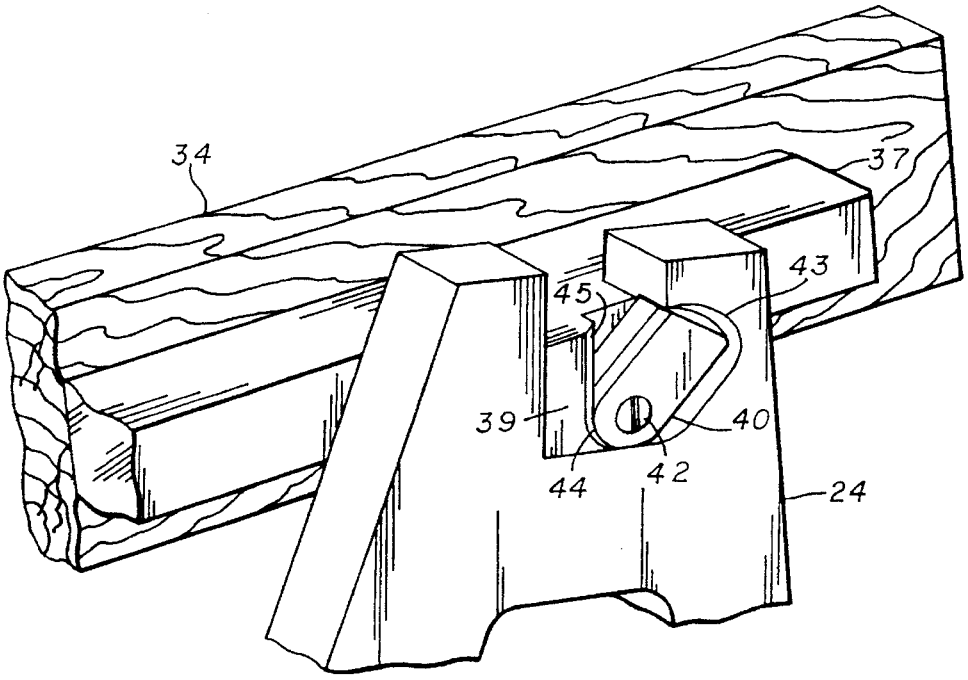
FIG. 4 is a perspective view of a portion of the assembled device in storage position.

The collapsability of the device is accomplished in the following manner. The working beam assembly is removed by pulling it from the slots, and the side supports 24 are folded flat against the inner face 19 of the main support 14, as shown in FIG. 3. The supports 24 are now in the same plane, and in a plane parallel to the plane of support 14. The slots 32 are now at an angle slanting inwardly toward the bottom edges 29 of each of the side suppors, but remain parallel to the longitudinal axis 41 thereof. The longitudinal axes 41 of these side supports are at acute angle with each other. The working beam assembly is then turned sideways as shown in FIG. 3, rotating it 90 degrees with respect to the main support 14. The lugs 39 mounted on the inner surface 36 of the beam support are also angled inwardly toward the bottom edges 29, so that the lugs fit precisely within the slots 32. The interfitting of the two assemblies is accomplished by rotating the operable lug locks 40, which are located on the outer sides of the lugs, as shown in FIG. 4. These locks, which are mounted by screws 42, are dimensioned to fit, when rotated as shown, within shallow grooves 43 which are extended portions of the slots 32. The locks are not as deep as the lugs, and have cammed surfaces 44 which ride against shoulders 45 during rotation. The beam assembly is now securely interlocked to the support assembly, so the entire device is a unit which is easily picked up and carried for storage or movement to another work area. Thus, storage may be accomplished in a more compact manner.

The specific embodiment described herein is merely exemplary, and other modifications may be made within the spirit of the invention.

We claim:

1. A collapsible work support device comprising an elongated working member having a longitudinal axis and having inner and outer surfaces and a separate support assembly for supporting said working member to place said device in a position for use, said assembly comprising a first planar support generally coextensive with said longitudinal axis of said working member and a pair of opposing planar side supports interengaged with said first support, said side supports having upper surfaces with openings formed therein aligned in a direction parallel to said longitudinal axis of said working member, said openings being in the form of slots having generally parallel vertical side surfaces, said working member being separate from said side supports and remaining as a separate member when in use, said working member having a support member secured to its inner surface and extending along said longitudinal axis thereof, said support member having a cross-sectional shape corresponding to the shape of said slots and interfitting with said slots, said side surfaces of said slots being the sole means for securing said support member within said slots without other fastening means therebetween, said support member causing said working member to be locked into place with said side supports and retained against movement relative to said support assembly, said support assembly capable of folding from supporting position to collapsed position for portability and storage.

2. The device of claim 1 wherein said supports are interengaged to form a three-sided member defining an open space.

3. The device of claim 1 wherein said working member is in a horizontal plane and said side supports are in planes parallel to each other and at right angles to the plane of said working member, when said supports are in supporting position.

4. The device of claim 3 wherein said first support is in a plane at an angle with the planes of said working member and said other supports.

5. The device of claim 1 wherein said first support is generally rectangular in shape and said side supports are generally trapezoidal in shape.

6. The device of claim 1 wherein said side supports are hingedly mounted directly on said first support for relative movement between supporting position and collapsed position.

7. The device of claim 1 further comprising means for limiting longitudinal movement of said working member when said device is in position for use, said means comprising members on said inner surface of said working member and contacting said side supports.

8. The device of claim 1 further comprising securing means on said working member interfitting with said openings in said side supports when said device is in collapsed position, wherein said working member remains as a separate member even when secured to said side supports.

9. The device of claim 8 wherein said securing means include operable locking means on said inner surface of said working member, and said openings include grooves, said locking means interfitting within said grooves.

10. The device of claim 1 wherein said side supports are in parallel planes to each other when in supporting position but lie in the same plane when in collapsed position.

11. The device of claim 10 wherein said side supports are placed flat against said first support in a plane parallel to the plane of said first support, when in collapsed position.

12. The device of claim 11 wherein said working member is in a plane parallel to the planes of said side supports when in collapsed position.

13. The device of claim 11 wherein the longitudinal axes of said side supports are at an acute angle with each other when in collapsed position.

14. In a collapsible work support device comprising an elongated working member having a longitudinal axis and having inner and outer surfaces and a separate support assembly comprising a first planar support generally coextensive with said longitudinal axis of said working member and a pair of opposing planar side supports interengaged with said first support, said side supports having upper surfaces with openings therein, said openings being in the form of slots having generally parallel vertical side surfaces, said working member having a support member secured to its inner surface and extending along said longitudinal axis thereof, said support member having a cross-sectional shape corresponding to the shape of said slots; the method of placing said device in a position for use comprising the steps of forming said supports into a three-sided configuration defining an open space by placing said first support coextensively with said working member and interengaging said side supports with said first support, aligning said openings in a direction parallel to the longitudinal axis of said working member, placing said support member into said openings for interlocking said working member with said support assembly, utilizing said vertical sides of said slots as the sole means securing said support member within said slots and utilizing said support member to secure said working member against movement relative to said support assembly while retaining said working member separate from said side supports.

15. The method of claim 14 including the further steps of placing said working member in a horizontal plane, and placing said side supports in planes parallel to each other and extending at approximately right angles to the plane of said working member.

16. In a collapsible work support device comprising an elongated working member having a longitudinal axis and having inner and outer surfaces, a support member having inner and outer surfaces and secured at its outer surface to said inner surface of said working member and securing means on said inner surface of said support member, a separate support assembly comprising a first planar support generally coextensive with the longitudinal axis of said working member and a pair of opposing planar supports interengaged with said first support, said side supports having upper surfaces with openings therein being in the form of slots having generally parallel side surfaces, said slots having extended portions forming grooves therein; the method of placing said device in a collapsed position for portability and storage comprising the steps of folding said side supports flat against said first support, placing said side supports in the same plane with each other and in a plane parallel to the plane of said first support, placing said securing means into said grooves for securing said working member to said support assembly, and retaining said working member as a separate member.

17. The method of claim 16 including the step of rotating said working member 90 degrees with respect to said first support prior to securing said working member to said support assembly.

18. The method of claim 16 wherein said working member has locking means thereon, said securing step comprising interlocking said locking means within said openings.

19. The method of claim 18 wherein said locking means includes operable means, said securing step comprising interfitting said operable means with said side supports.

* * * * *